US007975802B2

(12) United States Patent
Yokoya et al.

(10) Patent No.: US 7,975,802 B2
(45) Date of Patent: Jul. 12, 2011

(54) INTAKE AIR SOUND GENERATION DEVICE

(75) Inventors: Shigehiro Yokoya, Yokohama (JP); Yoshinori Yakabe, Yokohama (JP); Kyouji Hanada, Tokyo (JP); Junji Yoshida, Tokorozawa (JP); Masashi Shinada, Sayama (JP)

(73) Assignees: Nissan Motor Co., Ltd., Yokohama-shi (JP); Mahle Filter Systems Japan Corporation, Tokyo (JP)

( * ) Notice: Subject to any disclaimer, the term of this patent is extended or adjusted under 35 U.S.C. 154(b) by 0 days.

(21) Appl. No.: 12/404,630

(22) Filed: Mar. 16, 2009

(65) Prior Publication Data

US 2009/0236171 A1 Sep. 24, 2009

(30) Foreign Application Priority Data

Mar. 18, 2008 (JP) ..... 2008-069536

(51) Int. Cl.

| | |
|---|---|
| ***G10K 13/00*** | (2006.01) |
| ***F02M 35/10*** | (2006.01) |
| *F01N 1/16* | (2006.01) |
| *F02M 35/16* | (2006.01) |

(52) U.S. Cl. .... 181/160; 181/271; 181/250; 123/184.57

(58) Field of Classification Search ..... 181/160, 181/156, 204, 271, 273, 276, 277, 278, 266, 181/250, 270, 173; 123/184.57, 184.53; 381/423

See application file for complete search history.

(56) References Cited

U.S. PATENT DOCUMENTS

| | | | | |
|---|---|---|---|---|
| 2,069,242 | A * | 2/1937 | Graham | 381/163 |
| 2,458,043 | A * | 1/1949 | Zenner | 381/165 |
| 4,284,167 | A * | 8/1981 | Kozlow et al. | 181/172 |
| 4,547,631 | A * | 10/1985 | Nieuwendijk et al. | 381/161 |
| 4,577,495 | A * | 3/1986 | Bamer | 73/114.34 |
| 4,889,208 | A * | 12/1989 | Sugihara | 181/148 |
| 4,953,655 | A * | 9/1990 | Furukawa | 181/160 |

(Continued)

FOREIGN PATENT DOCUMENTS

DE 19704376 A1 * 8/1998

(Continued)

OTHER PUBLICATIONS

Translation Document of JP 58091328 A (previously cited). Apr. 2010.*

*Primary Examiner* — Edgardo San Martin
(74) *Attorney, Agent, or Firm* — Foley & Lardner LLP

(57) ABSTRACT

An intake air sound generation device 40 for an internal combustion engine 2, comprises an introduction tube 41 which is connected to an intake passage 30 of the internal combustion engine 2 to introduce an intake pulse of an intake system, a vibrating body 50 which has a vibration surface 52 that is vibrated by the intake pulse and an accordion portion 53 that promotes vibration of the vibration surface 52, and is provided to cover one end of the introduction tube 41, and a resonance tube 42 which is connected to the introduction tube 41 via the vibrating body 50 and increases a sound pressure in a predetermined frequency band of an intake air sound generated by the vibration of the vibration surface 52. Thus, the sound pressure of the intake air sound at the predetermined frequency can be increased, and the durability of the vibrating body 50 can be improved.

12 Claims, 6 Drawing Sheets

U.S. PATENT DOCUMENTS 5,731,552 A * 3/1998 Tsao ..... 181/156
5,924,398 A * 7/1999 Choi ..... 123/184.21
6,219,432 B1 * 4/2001 Fryer et al. ..... 381/398
6,285,773 B1 * 9/2001 Carme et al. ..... 381/418
6,551,389 B2 * 4/2003 Spannbauer et al. ..... 96/380
6,600,408 B1 * 7/2003 Walter et al. ..... 340/384.1
6,634,457 B2 * 10/2003 Paschereit et al. ..... 181/229
6,644,436 B2 * 11/2003 Hofmann et al. ..... 181/214
6,739,425 B1 * 5/2004 Griffin et al. ..... 181/171
6,848,410 B2 * 2/2005 Hoffmann et al. ..... 123/184.57
6,932,189 B2 * 8/2005 Helber et al. ..... 181/240
7,086,498 B2 * 8/2006 Choi et al. ..... 181/270
7,188,703 B2 * 3/2007 Hofmann et al. ..... 181/271
7,350,496 B2 * 4/2008 Nakayama et al. ..... 123/184.57
7,353,791 B2 * 4/2008 Sasaki et al. ..... 123/184.57
7,448,353 B2 * 11/2008 Shinada et al. ..... 123/184.57
7,464,788 B2 * 12/2008 Alex et al. ..... 181/250
7,487,755 B2 * 2/2009 Harada ..... 123/184.57
7,621,370 B2 * 11/2009 Abe et al. ..... 181/204
7,658,263 B2 * 2/2010 Jasnie et al. ..... 181/204
2005/0121255 A1 * 6/2005 Hofmann et al. ..... 181/250
2005/0133300 A1 * 6/2005 Hofmann et al. ..... 181/250
2006/0042873 A1 * 3/2006 Alex et al. ..... 181/250
2006/0060419 A1 * 3/2006 Alex et al. ..... 181/250
2006/0283658 A1 * 12/2006 Abe et al. ..... 181/204
2007/0044747 A1 * 3/2007 Sawatari et al. ..... 123/184.21
2007/0079784 A1 * 4/2007 Sasaki et al. ..... 123/184.53
2007/0131189 A1 * 6/2007 Shinada et al. ..... 123/184.57
2007/0277768 A1 * 12/2007 Takeuchi et al. ..... 123/184.57

FOREIGN PATENT DOCUMENTS

DE 10147059 A1 * 4/2003
EP 1431536 A1 * 6/2004
EP 1748420 A2 * 1/2007
JP 58091328 A * 5/1983
JP 2007-170228 A 7/2007
JP 2009270489 A * 11/2009

* cited by examiner

INTAKE AIR SOUND GENERATION DEVICE

FIELD OF THE INVENTION

This invention relates to an intake air sound generation device for an internal combustion engine.

BACKGROUND OF THE INVENTION

JP2007-170228A, published by the Japan Patent Office in 2007, discloses an internal combustion engine comprising an intake air sound generation device that causes a diaphragm to vibrate using an intake pulse and increases the sound pressure at a predetermined frequency of a resulting intake air sound using a resonance tube. According to the intake air sound generation device, a powerful intake air sound can be obtained within a vehicle cabin.

SUMMARY OF THE INVENTION

However, in the intake air sound generation device according to the prior art, the disc-shaped diaphragm is fixed by sandwiching an outer edge of the diaphragm between an introduction tube and the resonance tube, and therefore the diaphragm does not vibrate easily. To ensure that the diaphragm vibrates easily, the diaphragm may be formed from rubber having a low modulus of elasticity, but this type of rubber diaphragm exhibits poor member strength as a vibrating body, and is therefore problematic in terms of lifespan and durability.

It is therefore an object of this invention to provide an intake air sound generation device with which the durability of a vibrating body can be improved and the sound pressure of an intake air sound can be increased.

To achieve this object, this invention provides an intake air sound generation device for an internal combustion engine comprising an introduction tube which is connected to an intake passage of the internal combustion engine to introduce an intake pulse of an intake system, a vibrating body which has a vibration surface that is vibrated by the intake pulse and an accordion portion that promotes vibration of the vibration surface, and is provided to cover one end of the introduction tube, and a resonance tube which is connected to the introduction tube via the vibrating body and increases a sound pressure in a predetermined frequency band of an intake air sound generated by the vibration of the vibration surface.

The details as well as other features and advantages of this invention are set forth in the remainder of the specification and are shown in the accompanying drawings.

DESCRIPTION OF THE PREFERRED EMBODIMENTS

Referring to FIG. 1, FIGS. 2A and 2B, FIGS. 3A and 3B, and FIG. 4, a first embodiment of this invention will be described.

Figure 1:
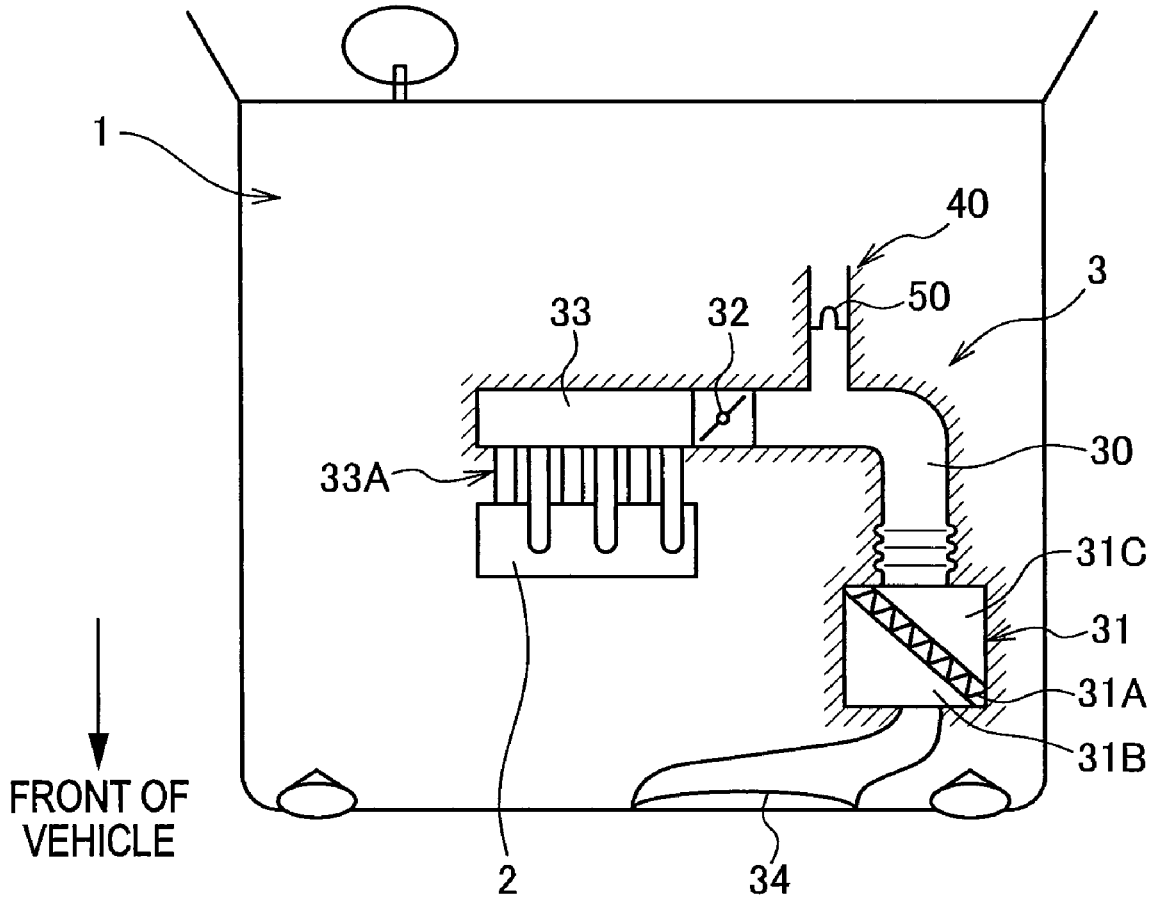
FIG. 1 is a schematic plan view of an engine room of a vehicle comprising an intake air sound generation device according to a first embodiment of this invention.

FIG. 1 shows the interior of an engine room 1 of a vehicle. The lower side of the drawing corresponds to the front of the vehicle.

A six-cylinder internal combustion engine 2 is disposed in the interior of the engine room 1.

The internal combustion engine 2 includes an intake system 3 that supplies fresh air taken in from the outside to each cylinder. The intake system 3 comprises an intake passage 30, an air cleaner 31, a throttle 32, and an intake manifold 33.

The intake passage 30 includes an intake port 34 located at the front of the vehicle for taking intake air in. The air cleaner 31 and the throttle 32 are disposed in the intake passage 30 in sequence from an upstream side. A downstream end of the intake passage 30 is connected to the intake manifold 33.

The air cleaner 31 is divided into a dust side 31B and a clean side 31C by a filter element 31A. The filter element 31A of the air cleaner 31 removes dust and dirt from the intake air.

The throttle 32 adjusts the flow rate of intake air that flows through the intake passage 30 by varying an intake passage area.

The intake manifold 33 comprises a plurality of branch pipes 33A. Branch pipes 33A communicate respectively with the cylinders of the internal combustion engine 2. Having passed through the throttle 32, the intake air is distributed to each cylinder of the internal combustion engine 2 via the intake manifold 33.

In the intake system 3 described above, an intake pulse is generated by the reciprocating motion of a piston and an intake valve provided in the internal combustion engine 2. To generate an intake air sound using the intake pulse, an intake air sound generation device 40 is provided in the intake passage 30 between the air cleaner 31 and the throttle 32.

The intake air sound generation device 40 generates an intake air sound by causing a vibrating body 50 to vibrate using the intake pulse as an excitation source, and then transmits the generated intake air sound to the interior of a vehicle cabin.

Figure 2A:
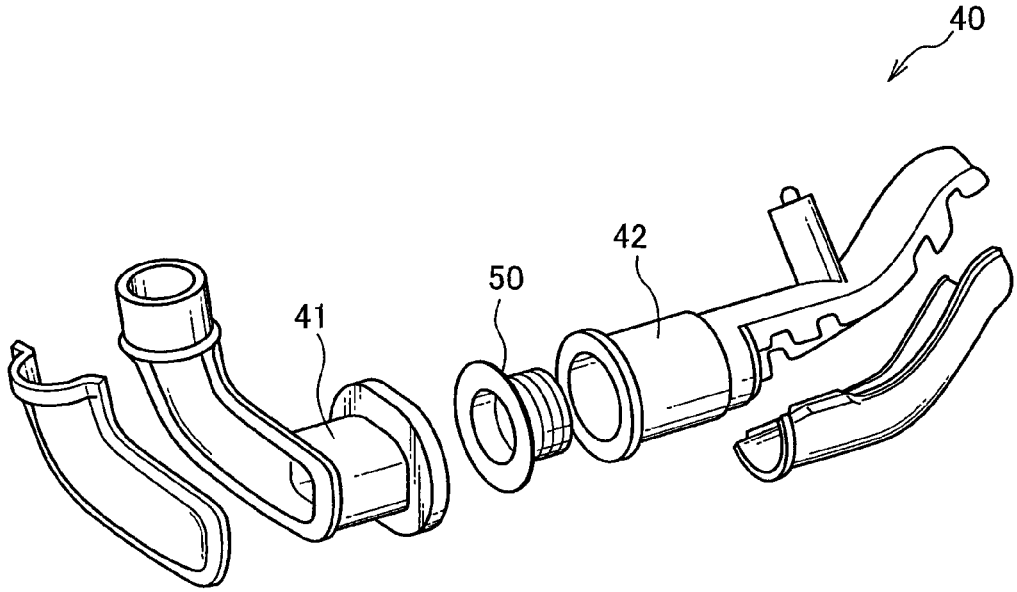
FIGS. 2A and 2B are an exploded perspective view and a longitudinal sectional view of the intake air sound generation device.

Referring to FIG. 2A, the intake air sound generation device 40 comprises the vibrating body 50, which vibrates using the intake pulse, an introduction tube 41 for introducing the intake pulse in the intake passage 30, and a resonance tube 42 for increasing a sound pressure of the intake air sound in a predetermined frequency band.

Figure 2B:
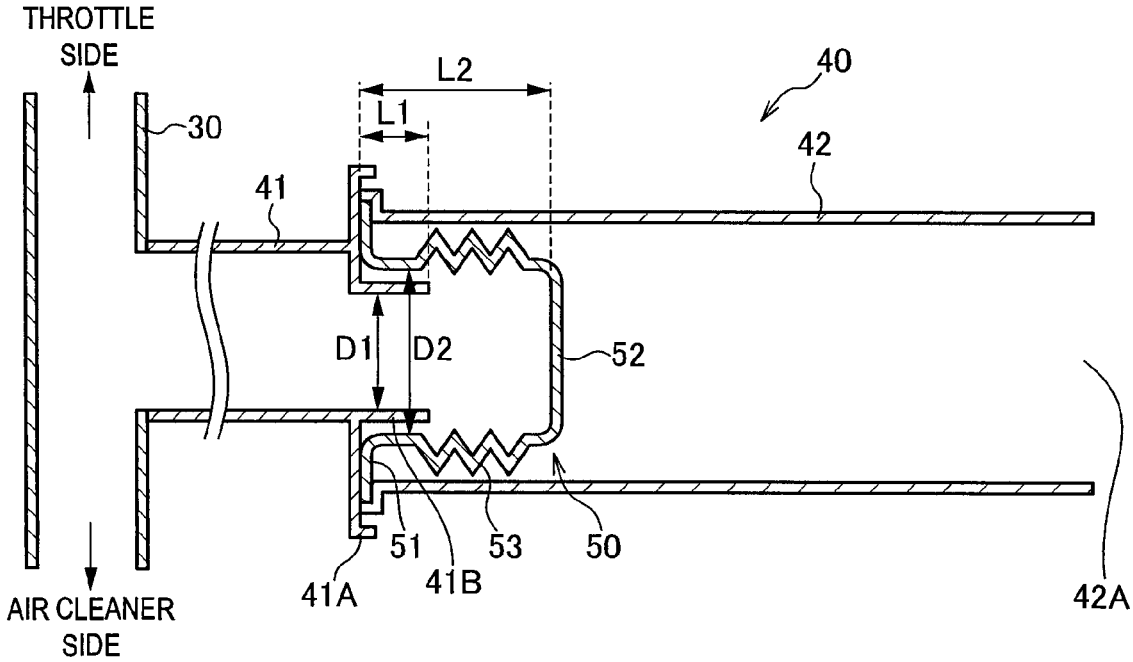

Referring to FIG. 2B, in the intake air sound generation device 40, the introduction tube 41 and the resonance tube 42 are connected such that a flange portion 51 of the vibrating body 50 is gripped between the introduction tube 41 and the resonance tube 42.

One end side of the introduction tube 41 is connected to the intake passage 30 between the air cleaner 31 and the throttle 32, and the other end side of the introduction tube 41 is connected to an upstream side of the resonance tube 42. A flange 41A is formed on the other end side of the introduction tube 41. An insertion tube 41B that is inserted into the interior of the vibrating body 50 is formed on the other end side of the introduction tube 41. An inner diameter of the insertion tube 441B is set to be smaller than an inner diameter of the introduction tube 41.

The vibrating body 50 is fixed to an end portion of the introduction tube 41 so as to cover the insertion tube 41B and housed in the interior of the resonance tube 42. The vibrating body 50 is formed from a polyester-based thermoplastic elastomer (TPEE), which is a resin that exhibits a rubber-like characteristic but has greater member strength than rubber. The vibrating body 50 is formed in a cylindrical shape having one closed end, or in other words in a cup shape. The vibrating body 50 comprises the flange portion 51, a vibration surface 52, and an accordion portion 53.

The disc-shaped flange portion 51 is formed on an open end side of the vibrating body 50. The flange portion 51 sandwiched between the introduction tube 41 and the resonance tube 42 is also welded to these members.

The vibration surface 52 is formed as a closed end surface of the vibrating body 50. The vibration surface 52 vibrates using the intake pulse as an excitation source.

The accordion portion 53 is formed on a cylindrical side of the vibrating body 50. The accordion portion 53 is formed such that the vibration surface 52 can vibrate easily in a left-right direction of the drawing.

In the intake air sound generation device 40, the vibration surface 52 of the vibrating body 50 is caused to vibrate by pressure variation in the intake pulse led into the introduction tube 41, and as a result of the vibration, an intake air sound is generated as a sound wave in the interior of the resonance tube 42.

The resonance tube 42 increases the sound pressure of the intake air sound in a predetermined frequency band by means of so-called air column resonance. An opening portion 42A that opens onto the outside is provided on a downstream side of the resonance tube 42. The increased intake air sound is discharged from the opening portion 42A. To ensure that the intake air sound can be heard easily in the vehicle cabin, the opening portion 42A is disposed in a position of the engine room 1 where sound insulation is unlikely to occur. By adjusting an axial direction length and an inner diameter of the resonance tube 42, the sound pressure of the intake air sound in the target frequency band can be increased.

It should be noted that in this embodiment, the axial direction length and inner diameter of the resonance tube 42 are set such that the sound pressure of the intake air sound on a high frequency side is increased.

In a vehicle comprising the intake air sound generation device 40, the intake air sound is generated by the vibrating body 50 using the intake pulse, and the sound pressure of the intake air sound in a predetermined frequency band is increased by the resonance tube 42, and as a result, a powerful intake air sound can be obtained in the vehicle cabin.

Incidentally, by optimizing an insertion tube length $L_1$ and an insertion tube inner diameter $D_1$ of the insertion tube 41B that is inserted into the vibrating body 50 in the intake air sound generation device 40, the sound pressure during intake air sound generation can be increased to a maximum degree. When the sound pressure in the predetermined frequency band is increased using the resonance tube 42 after increasing the sound pressure during intake air sound generation in this manner, the intake air sound can be heard more easily in the vehicle cabin.

Hence, in the intake air sound generation device 40, the shape of the insertion tube 41B is optimized so that the sound pressure during intake air sound generation can be increased to a maximum degree on the basis of (1) a sound pressure characteristic based on a length ratio $R_L$ obtained by dividing the insertion tube length $L_1$ by a vibrating body length $L_2$ and (2) a sound pressure characteristic based on an inner diameter ratio $R_D$ obtained by dividing the insertion tube inner diameter $D_1$ by a vibrating body inner diameter $D_2$.

As shown in FIG. 2B, the insertion tube length $L_1$ is the length of the insertion tube 41B inserted into the vibrating body 50 from the open end of the vibrating body 50, and the vibrating body length $L_2$ is a length of the vibrating body 50 from the open end to the vibration surface 52. Further, the insertion tube inner diameter $D_1$ is the diameter of the insertion tube 41B, and the vibrating body inner diameter $D_2$ is the diameter of the vibrating body 50 formed in a cylindrical shape.

Figure 3A:
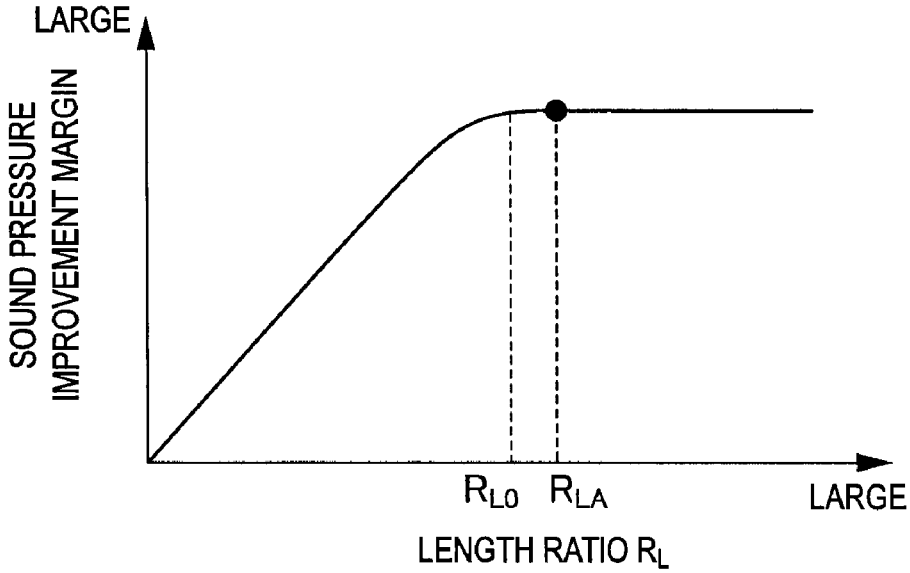
FIGS. 3A and 3B are diagrams illustrating a sound pressure improvement margin of an intake air sound generated by the intake air sound generation device.
Figure 3B:
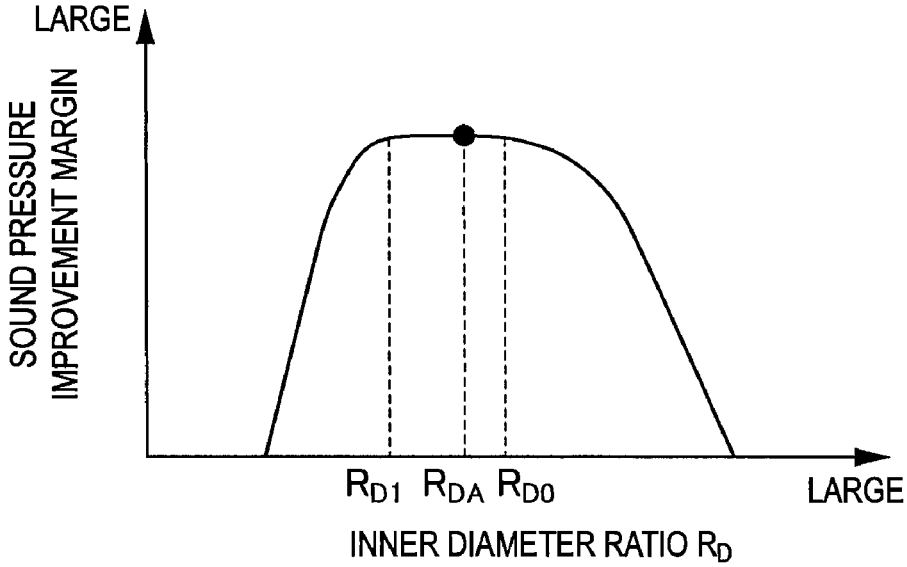

Referring to FIGS. 3A and 3B, a sound pressure improvement margin based on the length ratio $R_L$ and a sound pressure improvement margin based on the inner diameter ratio $R_D$ will be described.

(1) Sound Pressure Improvement in Intake Air Sound Based on Length Ratio $R_L$

Referring to FIG. 3A, up to the point at which the length ratio $R_L$ exceeds a predetermined value $R_{L0}$, the sound pressure improvement margin of the intake air sound increases steadily as the length ratio $R_L$ increases, or in other words as the end portion of the insertion tube 41B approaches the vibration surface 52 of the vibrating body 50. When the length ratio $R_L$ exceeds the predetermined value $R_{L0}$, the sound pressure improvement margin becomes constant.

The intake pulse from the insertion tube 41B spreads through the vibrating body 50 in a radial form, but as the end portion of the insertion tube 41B approaches the vibration surface 52, the intake pulse from the insertion tube 41B becomes more likely to impinge on the vibration surface 52, and therefore vibration of the vibration surface 52 increases, leading to an increase in the sound pressure improvement margin of the intake air sound. However, once the end portion of the insertion tube 41B has approached the vibration surface 52 to a certain degree, most of the intake pulse impinges on the vibration surface 52, and therefore the sound pressure improvement margin of the intake air sound becomes constant.

Hence, in the intake air sound generation device 40, the sound pressure during intake air sound generation is increased by determining the insertion tube length $L_1$ of the insertion tube 41B such that the length ratio $R_L$ is greater than the predetermined value $R_{L0}$. It should be noted, however, that if the length ratio $R_L$ is increased excessively such that the end portion of the insertion tube 41B comes too close to the vibration surface 52, the vibration surface 52 of the vibrating body 50 may contact the insertion tube 41B when the vibration surface 52 vibrates. Therefore, the insertion tube length $L_1$ of the insertion tube 41B is determined such that the length ratio $R_L$ is greater than the predetermined value $R_{L0}$ within a range in which the vibration surface 52 does not contact the insertion tube 41B.

(2) Sound Pressure Improvement in Intake Air Sound Based on Inner Diameter Ratio $R_D$ Referring to FIG. 3B, when the inner diameter ratio $R_D$ is between a predetermined value $R_{D1}$ and a predetermined value $R_{D0}$, the sound pressure improvement margin of the intake air sound is maximized.

Up to the point at which the inner diameter ratio $R_D$ falls below the predetermined value $R_{D0}$, the amplitude of pressure variation in the intake pulse that flows into the insertion tube 41B from the introduction tube 41 increases steadily as the inner diameter ratio $R_D$ decreases, or in other words as the inner diameter of the insertion tube 41B decreases. As a result, vibration of the vibration surface 52 of the vibrating body 50 increases, leading to an increase in the sound pressure improvement margin of the intake air sound. When the inner diameter ratio $R_D$ falls below the predetermined value $R_{D0}$, the amplitude of pressure variation in the intake pulse no longer increases, and therefore the sound pressure improvement margin becomes substantially constant. However, when the inner diameter ratio $R_D$ falls below the predetermined value $R_{D1}$, the inner diameter of the insertion tube 41B becomes too small, and therefore the intake pulse cannot pass through the insertion tube 41B easily. As a result, the vibration surface 52 is not excited easily, leading to a reduction in the sound pressure improvement margin.

Hence, in the intake air sound generation device 40, the sound pressure during intake air sound generation is increased by determining the insertion tube inner diameter $D_1$ of the insertion tube 41B such that the inner diameter ratio $R_D$ is between the predetermined value $R_{D1}$ and the predetermined value $R_{D0}$.

On a basis of (1) and (2), the shape of the insertion tube 41B of the intake air sound generation device 40 is optimized by setting the insertion tube length $L_1$ such that the length ratio $R_L$ corresponds to a predetermined value $R_{LA}$ and setting the insertion tube inner diameter $D_1$ such that the inner diameter ratio $R_D$ corresponds to a predetermined value $R_{DA}$.

Figure 4:
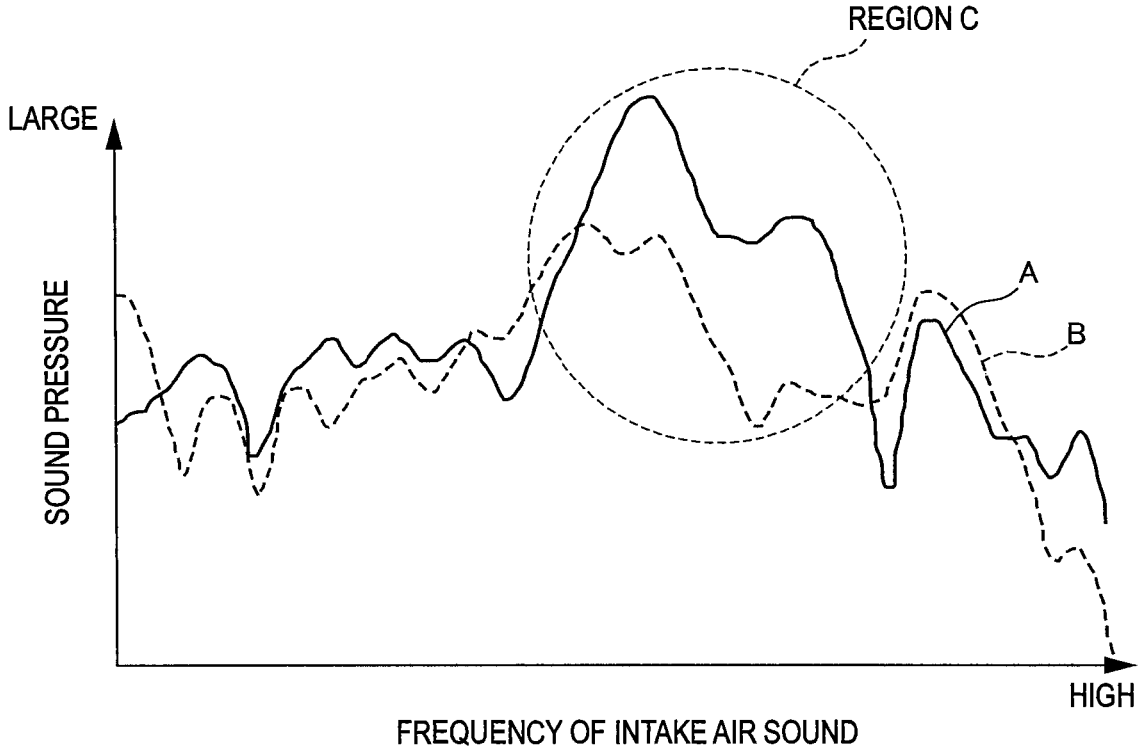
FIG. 4 is a diagram illustrating a frequency-sound pressure characteristic of the intake air sound in a vehicle cabin.

Referring to FIG. 4, the sound pressure in the vehicle cabin of the intake air sound generated by the intake air sound generation device 40 will be described.

FIG. 4 is a sound pressure characteristic diagram showing a relationship between the frequency and the sound pressure of a sixth order intake air sound in a vehicle cabin. In the intake air sound generation device 40, an intake air sound of an order determined on the basis of the number of engine cylinders is discharged from the opening portion 42A of the resonance tube 42, and therefore, in the case of a six cylinder engine, a sixth order intake air sound is dominant.

A solid line A in FIG. 4 shows the sound pressure characteristic of the intake air sound generation device 40 when the insertion tube shape is optimized. A dot line B shows a sound pressure characteristic of an intake air sound generation device serving as a comparative example, in which an insertion tube is not provided and a vibrating body is disposed on an end portion of an introduction tube.

In the intake air sound generation device 40, the resonance tube 42 is set to increase the sound pressure of a high-frequency intake air sound, and moreover, the shape of the insertion tube 41B is optimized to increase the sound pressure during intake air sound generation. Hence, in comparison with the intake air sound generation device serving as a comparative example, the sound pressure of the intake air sound is particularly improved on a high frequency side indicated by a region C. As a result, an intake air sound having a target predetermined frequency can be heard easily in the vehicle cabin.

With the intake air sound generation device 40 according to the first embodiment described above, the following effects can be obtained.

In the intake air sound generation device 40, the accordion portion 53 that promotes vibration of the vibration surface 52 is provided on the cylindrical side of the vibrating body 50 disposed between the introduction tube 41 and the resonance tube 42, and therefore, even when the vibrating body 50 is formed from a resin having greater member strength than rubber, vibration of the vibration surface 52 is not impaired. Hence, with the intake air sound generation device 40, the sound pressure of the intake air sound at the predetermined frequency can be increased by the resonance tube 42, and moreover, the durability of the vibrating body 50 can be improved.

Further, in the intake air sound generation device 40, the insertion tube 41B is formed on the end portion of the introduction tube 41, and therefore the sound pressure during intake air sound generation can be increased. As a result, a more powerful intake air sound can be obtained in the vehicle cabin.

Furthermore, in the intake air sound generation device 40, the shape of the insertion tube is optimized in relation to the shape of the vibrating body, and therefore the sound pressure during intake air sound generation can be increased efficiently.

Referring to FIGS. 5A and 5B and FIGS. 6A and 6B, a second embodiment of this invention will be described.

The intake air sound generation device 40 according to the second embodiment has a substantially identical constitution to that of the first embodiment, but differs therefrom in a part of the constitution of the resonance tube 42.

When a backfire occurs in the internal combustion engine 2, an extremely large pressure wave, i.e. a so-called excessive pulse, is formed in the interior of the intake system 3. When the excessive pulse is received by the vibration surface 52 of the vibrating body 50, the vibrating body 50 extends excessively in the axial direction, and as a result, the vibrating body 50 may be damaged.

Figure 5A:
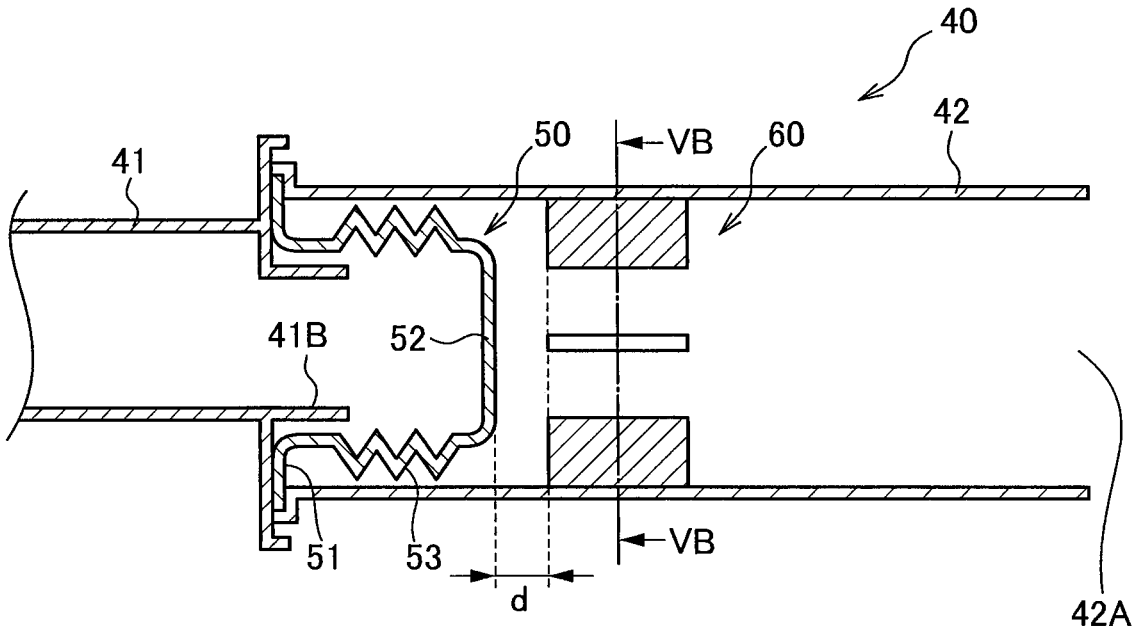
FIGS. 5A and 5B are a longitudinal sectional view and a principal transverse sectional view of an intake air sound generation device according to a second embodiment of this invention.

Hence, in the intake air sound generation device 40 according to the second embodiment, a stopper 60 for restricting the position of the vibration surface 52 of the vibrating body 50 is formed in the interior of the resonance tube 42, as shown in FIG. 5A.

Figure 5B:
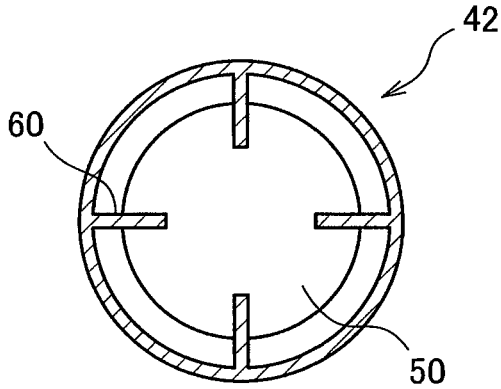

Referring to FIGS. 5A and 5B, the stopper 60 projects from an inner peripheral wall of the resonance tube 42 toward the center of the resonance tube 42 and is formed as a plate-shaped projection extending in the axial direction of the resonance tube 42. Four stoppers 60 are provided at equal intervals in an inner peripheral direction of the resonance tube 42. An end portion of the stopper 60 opposes the vibration surface 52, and an interval d is set between the stopper 60 and the vibration surface 52 of the vibrating body 50. The stopper 60 may be formed integrally with the resonance tube 42, or the stopper 60 and the resonance tube 42 may be formed separately.

By forming the stopper 60 in the resonance tube 42, the vibration surface 52 contacts the stopper 60 when it receives the excessive pulse such that the vibrating body 50 extends, and therefore the vibrating body 50 does not extend excessively. As a result, damage to the vibrating body 50 due to an excessive pulse is suppressed.

Incidentally, in the intake air sound generation device 40, a resonance frequency of the resonance tube 42 can be adjusted by adjusting (3) a drawing rate $R_S$ obtained by dividing a stopper sectional area in an orthogonal direction to the resonance tube axial direction by a resonance tube sectional area, and (4) the interval d between the vibration surface 52 and the stopper 60. The intake pulse in the vicinity of the resonance frequency of the introduction tube 41 is also increased by the resonance effect in the introduction tube 41, but by bringing the resonance frequency of the introduction tube 41 and the resonance frequency of the resonance tube 42 into closer alignment, the sound pressure of the intake air sound in the predetermined frequency band can be increased.

Figure 6A:
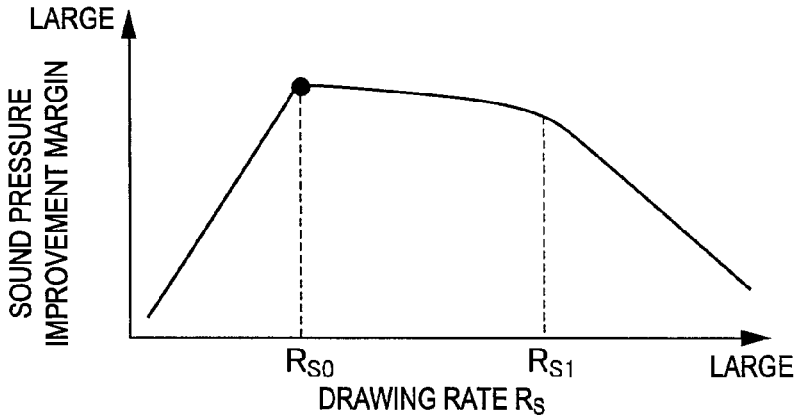
FIGS. 6A-6C are diagrams illustrating a sound pressure improvement margin and a frequency-sound pressure characteristic of an intake air sound generated by the intake air sound generation device according to the second embodiment.
Figure 6B:
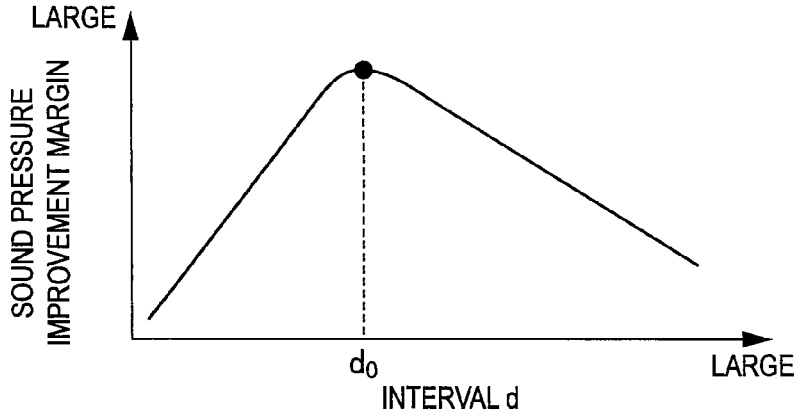

FIG. 6A shows a sound pressure improvement margin based on the drawing rate $R_S$, and FIG. 6B shows a sound pressure improvement margin based on the interval d between the vibration surface 52 and the stopper 60.

(3) Sound Pressure Improvement in Intake Air Sound Based on Drawing Rate $R_S$

Referring to FIG. 6A, by varying the sectional area of the stopper 60 to vary the drawing rate $R_S$, the resonance frequency of the resonance tube 42 can be modified, and when the drawing rate $R_S$ reaches a predetermined value $R_{S0}$, the sound pressure improvement margin of the intake air sound reaches a maximum. The reason for this is that when the drawing rate $R_S$ reaches the predetermined value $R_{S0}$, the resonance frequency of the resonance tube 42 approaches the resonance frequency of the introduction tube 41. Further, up to the point at which the drawing rate $R_S$ exceeds the predetermined value $R_{S0}$, the amplitude of pressure variation in the intake air sound pressure wave passing through the stopper 60 increases steadily as the drawing rate $R_S$ increases, or in other words as the sectional area of the resonance tube 42 in the stopper position decreases, and as a result, the sound pressure improvement margin of the intake air sound increases. When the drawing rate $R_S$ exceeds a predetermined value $R_{S1}$, however, the sectional area of the resonance tube 42 becomes too small, and therefore the intake air sound is easily insulated. As a result, the sound pressure improvement margin decreases.

(4) Sound Pressure Improvement in Intake Air Sound Based on Interval d

Referring to FIG. 6B, by varying the interval d between the stopper 60 and the vibration surface 52, the resonance frequency of the resonance tube 42 can be modified, and when the interval d reaches a predetermined value $d_0$, the sound pressure improvement margin of the intake air sound reaches a maximum. The reason for this is that when the interval d reaches the predetermined value $d_0$, the resonance frequency of the resonance tube 42 approaches the resonance frequency of the introduction tube 41.

On a basis of (3) and (4), the shape of the stopper 60 in the intake air sound generation device 40, can be optimized by setting the sectional area of the stopper 60 such that the drawing rate $R_S$ corresponds to the predetermined value $R_{S0}$ and setting the interval d between the stopper 60 and the vibration surface 52 to correspond to the predetermined value $d_0$.

Figure 6C:
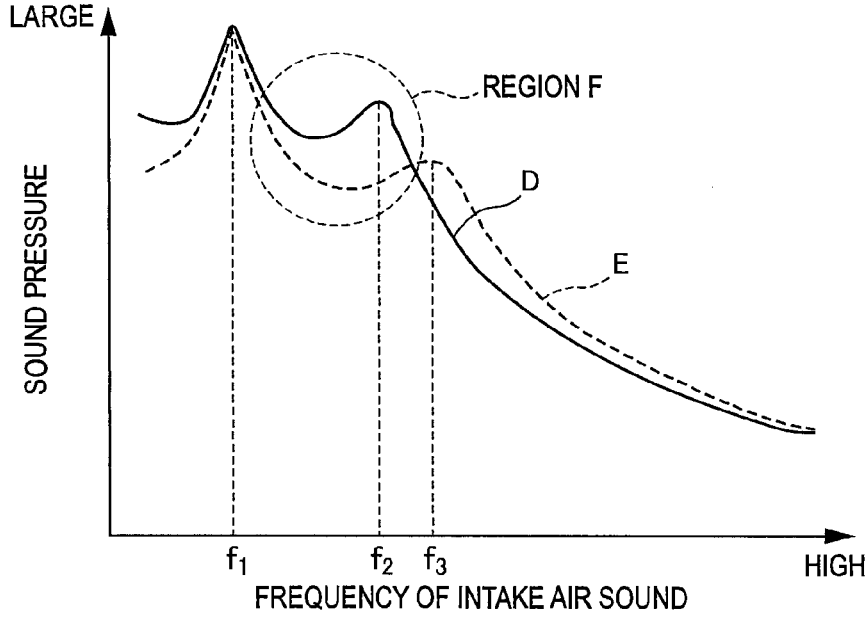

FIG. 6C is a sound pressure characteristic diagram showing a relationship between the frequency and the sound pressure of the sixth order intake air sound in the vehicle cabin. FIG. 6C shows a high frequency side of the intake air sound.

Referring to FIG. 6C, a solid line D shows a sound pressure characteristic of the intake air sound generation device 40 having the optimally constituted stopper 60. A dot line E shows a sound pressure characteristic of an intake air sound generation device not formed with a stopper, which serves as a comparative example.

In the intake air sound generation device not formed with a stopper, the resonance frequency of the resonance tube is $f_3$, whereas in the intake air sound generation device 40 having the optimally constituted stopper 60, the resonance frequency of the resonance tube 42 is $f_2$, which is closer to a resonance frequency $f_1$ of the introduction tube 41. Hence, in the intake air sound generation device 40 having the stopper 60, a particular improvement in the sound pressure of the intake air sound in the resonance frequency band of the resonance tube 42 can be achieved in a region F, as shown by the solid line D. As a result, an intake air sound of a predetermined target frequency can be heard easily in the vehicle cabin.

With the intake air sound generation device 40 according to the second embodiment described above, the following effects can be obtained.

In the intake air sound generation device 40, the stopper 60 is formed in the resonance tube 42, and therefore the vibration surface 52 contacts the stopper 60 when it receives the excessive pulse such that the vibrating body 50 extends. As a result, damage to the vibrating body 50 caused by the excessive pulse can be suppressed.

Further, with the intake air sound generation device 40, the resonance frequency of the resonance tube 42 can be adjusted in accordance with the sectional area and disposal position of the stopper 60, and therefore the sound pressure of the intake air sound at a predetermined frequency can be increased.

The contents of JP2008-69536, with a filing date of Mar. 18, 2008 in Japan, are hereby incorporated by reference.

Although the invention has been described above with reference to certain embodiments, the invention is not limited to the embodiments described above. Modifications and variations of the embodiments described above will occur to those skilled in the art, within the scope of the claims.

For example, in the first embodiment, the vibrating body 50 is constituted by TPEE, but the vibrating body 50 may be constituted by rubber. In this case, the rubber thickness is increased to secure sufficient member strength in the vibrating body 50. However, even though the rubber thickness is increased, the vibrating body 50 includes the accordion portion 53, and therefore vibration of the vibration surface 52 is not impaired.

Further, in the first embodiment, the inner diameter of the insertion tube 41B is determined on the basis of the inner diameter ratio $R_D$ such that the sound pressure of the intake air sound increases, but the opening area of the insertion tube 41B may be determined on the basis of a relationship between the sound pressure improvement margin and a opening area ratio obtained by dividing the opening area of the insertion tube 41B by the opening area of the vibrating body 50.

The embodiments of this invention in which an exclusive property or privilege are claimed are defined as follows:

What is claimed is:

1. An intake air sound generation device for an internal combustion engine, comprising:

an introduction tube which is connected to an intake passage of the internal combustion engine to introduce an intake pulse of an intake system;

a vibrating body which has a vibration surface that is vibrated by the intake pulse and an accordion portion that promotes vibration of the vibration surface, and is provided to cover one end of the introduction tube; and a resonance tube which is connected to the introduction tube via the vibrating body and increases a sound pressure in a predetermined frequency band of an intake air sound generated by the vibration of the vibration surface, wherein the introduction tube comprises an insertion tube which is inserted into the vibrating body.

2. The intake air sound generation device according to claim 1, wherein the vibrating body is formed in a shape of a cylinder, wherein the vibration surface is formed as an end surface closing one end of the cylinder, and wherein the accordion portion is formed in an axial direction along a side of the cylinder.

3. The intake air sound generation device according to claim 2, wherein the vibrating body comprises a flange portion on another end of the cylinder, wherein the another end of the cylinder is open, and wherein the flange portion is fixed between an end portion of the introduction tube and an end portion of the resonance tube by welding.

4. The intake air sound generation device according to claim 1, wherein the insertion tube is formed to have a smaller inner diameter than an inner diameter of the introduction tube.

5. The intake air sound generation device according to claim 4, wherein an insertion length of the insertion tube is determined on a basis of a relationship between a sound pressure improvement margin and a length ratio obtained by dividing the insertion length of the insertion tube by a length of the vibrating body from an open end of the vibrating body to the vibration surface, such that the sound pressure of the intake air sound increases.

6. The intake air sound generation device according to claim 4, wherein an opening area of the insertion tube is determined on a basis of a relationship between a sound pressure improvement margin and an opening area ratio obtained by dividing the opening area of the insertion tube by an opening area of the vibrating body, such that the sound pressure of the intake air sound increases.

7. The intake air sound generation device according to claim 1, wherein the resonance tube comprises a stopper that restricts a position of the vibration surface when an excessive pulse is input.

8. The intake air sound generation device according to claim 7, wherein the stopper is formed to project from an interior of the resonance tube so as to oppose a part of the vibration surface.

9. The intake air sound generation device according to claim 8, wherein the stopper is formed in a plurality on an inner periphery of the resonance tube.

10. The intake air sound generation device according to claim 7, wherein a sectional area of the stopper in an orthogonal direction to a resonance tube axial direction is determined on a basis of a relationship between a sound pressure improvement margin and a drawing rate obtained by dividing the stopper sectional area by a resonance tube sectional area, such that the sound pressure of the intake air sound increases.

11. The intake air sound generation device according to claim 7, wherein a disposal position of the stopper is determined on a basis of a relationship between a sound pressure improvement margin and an interval between the vibration surface and the stopper such that the sound pressure of the intake air sound increases.

12. The intake air sound generation device according to claim 1, wherein the vibrating body is formed from a polyester-based thermoplastic elastomer, which is a resin that exhibits a rubber-like characteristic.

* * * * *